US008033661B2

(12) United States Patent
Schierholz et al.

(10) Patent No.: US 8,033,661 B2
(45) Date of Patent: Oct. 11, 2011

(54) METHOD FOR INKJET PRINTING WITH LIGHT-CURABLE INK

(75) Inventors: Albrecht Schierholz, Schieder-Schwalenberg (DE); Dieter Stellmach, Bad Duerrheim (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 473 days.

(21) Appl. No.: 12/162,242

(22) PCT Filed: Jan. 19, 2007

(86) PCT No.: PCT/EP2007/000461

§ 371 (c)(1),
(2), (4) Date: Jul. 25, 2008

(87) PCT Pub. No.: WO2007/085384

PCT Pub. Date: Aug. 2, 2007

(65) Prior Publication Data

US 2009/0040284 A1 Feb. 12, 2009

(30) Foreign Application Priority Data

Jan. 25, 2006 (DE) ..... 10 2006 003 765

(51) Int. Cl.
*B41J 2/01* (2006.01)

(52) U.S. Cl. ..... 347/102; 347/101

(58) Field of Classification Search ..... 347/102, 347/101

See application file for complete search history.

(56) References Cited

U.S. PATENT DOCUMENTS

| | | | | |
|---|---|---|---|---|
| 5,013,343 | A | 5/1991 | Miyamoto et al. | |
| 5,144,889 | A | 9/1992 | Alig et al. | |
| 6,092,890 | A | 7/2000 | Wen et al. | |
| 6,447,112 | B1 * | 9/2002 | Hu et al. | 347/102 |
| 2003/0035037 | A1 | 2/2003 | Mills et al. | |
| 2003/0081096 | A1 * | 5/2003 | Young | 347/102 |
| 2004/0141040 | A1 | 7/2004 | Nakajima | |
| 2006/0230969 | A1 * | 10/2006 | Vosahlo | 101/488 |
| 2007/0273739 | A1 * | 11/2007 | Rodin et al. | 347/102 |
| 2011/0058000 | A1 * | 3/2011 | Rodin et al. | 347/102 |

FOREIGN PATENT DOCUMENTS

| | | | |
|---|---|---|---|
| CN | 1377313 | A | 10/2002 |
| CN | 1454159 | A | 11/2003 |
| DE | 3717333 | | 12/1987 |
| DE | 3825773 | | 2/1990 |

(Continued)

*Primary Examiner* — Matthew Luu
*Assistant Examiner* — Rut Patel
(74) *Attorney, Agent, or Firm* — Leydig, Voit & Mayer, Ltd.

(57) ABSTRACT

A method for inscribing a substrate with an inkjet printer using a light-curing ink. The method includes traversing, by the carriage, to the first end position at a first travel speed. The light-curing ink is sprayed-on along an inscription row onto the substrate using the print head during the traversing to the first end position. The sprayed-on ink is irradiated, for curing, using the illumination head during the traversing to the first end position. The carriage is traversed from the first end position to the second end position along the inscription row at a second travel speed, the second travel speed being lower than the first travel speed. The print head is inactive during the traversing to the second end position. The sprayed-on ink is irradiated using the illumination head during the traversing to the second end position. The substrate is then advanced using the transport apparatus.

4 Claims, 2 Drawing Sheets

FOREIGN PATENT DOCUMENTS * cited by examiner

| | | | |
|---|---|---|---|
| DE | 4018077 | | 12/1991 |
| EP | 0842051 | B1 | 2/2000 |
| WO | WO 01/83223 | A | 11/2001 |
| WO | WO 2004/002746 | A | 1/2004 |
| WO | WO 2005/039883 | A | 5/2005 |

METHOD FOR INKJET PRINTING WITH LIGHT-CURABLE INK

CROSS REFERENCE TO PRIOR APPLICATIONS

This application is a U.S. National Phase application under 35 U.S.C. §371 of International Application No. PCT/EP2007/000461, filed on Jan. 19, 2007 and claims benefit to German Patent Application No. DE 10 2006 003 765.0, filed on Jan. 25, 2006. The International Application was published in German on Aug. 2, 2007 as WO 2007/085384 under PCT Article 21 (2).

FIELD

The present invention relates to a method for inscribing a substrate using an inkjet printing with light-curing ink.

BACKGROUND

It is commonly known to use light-curing inks when printing with inkjet printers. These contain multiple photoinitiators tuned to a predetermined short wavelength of light. Inkjet printers operable with light-curing inks comprise an illumination head for irradiation and illumination of the light-curing inks. During illumination, this head is moved along with the print head in traversing fashion between two housing sides of the inkjet printer, and irradiates the ink sprayed through print head nozzles onto the substrate. The wavelength of the emitted light is selected so that the photoinitiators are excited and the ink is at least partly polymerized. Polymerization results in an increase in the ink's viscosity, and in solidification of the ink. The degree of solidification depends on the irradiation duration and on the radiation power level of the illumination head.

The difficulty with inkjet printing, is that a very high radiation energy in a very short time is necessary in order to cure the ink sprayed onto the substrate. The energy necessary to cure UV-light-curing inks, is on the order of one joule. In order to apply the required energy even at high printing speeds, the radiation power levels required from an illumination head traveling along with the print head are in the kilowatt range. In the context of a fast-moving print head, an illumination head having a very high radiation power level must be selected so that the ink is solidified, and so that spreading of the ink is effectively prevented.

To achieve a sufficiently high radiation power level, the dimensions selected for the illumination head must be so large that it is no longer suitable for use in an inkjet printer embodied as a desktop unit. If a smaller illumination head is used in an inkjet printer embodied as a desktop unit, the risk then exists, especially when imprinting a non-absorbent substrate having capillary structures on the surface, that the ink applied onto the surface of the substrate will spread, and the printed image represented by the sprayed-on ink will become increasingly less sharp with time.

The spreading process depends on the ratio between the surface tensions of the ink and of the substrate, and thus also on the surface roughness of the substrate. The rougher the surface to be imprinted, the more quickly the ink spreads into the capillary structures. Although there is little ink spreading when the substrate has a smooth surface with no capillary structures, it is once again disadvantageous in this context that the adhesion between the ink and the surface of the substrate is low, and that a smear-proof bond thus cannot be achieved.

U.S. Pat. No. 6,092,980 describes a method for inkjet printing with light-curing ink that corresponds to the method cited above. In accordance therewith, a printing machine is used that comprises a carriage having a print head and an illumination head. After the printing of multiple line segments, a check is made as to whether the ink has cured. If that is not the case, provision can be made for additional passes over the printed image, during which only the illumination head, but not the print head, is active.

U.S. Patent Application Publication No. US 2003/0035037 further describes a method for inkjet printing with light-curing ink. Here the printing machine that is used comprises a carriage having a print head, on each side of which is arranged one illumination head. Only the illumination head that trails the print head along the relevant printed line is active in each case. The irradiation intensity of the two illumination heads is, however, not sufficient to cure the printed image line by line. A post-irradiation unit is therefore described, the substrate having the printed image being conveyed through beneath said unit.

SUMMARY

An aspect of the present invention is to provide a method for inkjet printing with light-curing ink, which method can be carried out with an inkjet printer embodied as a desktop unit, and with which method a sharp-edged, cured printed image is generated.

In an embodiment, the present invention provides a method for inscribing a substrate with an inkjet printer using a light-curing ink, the printer including a carriage configured to traverse between a first end position and a second end position, a print head and an illumination head disposed on the carriage and a transport apparatus configured to move the substrate linewise. The method includes traversing, by the carriage, to the first end position at a first travel speed. The light-curing ink is sprayed-on along an inscription row onto the substrate using the print head during the traversing to the first end position. The sprayed-on ink is irradiated, for curing, using the illumination head during the traversing to the first end position. The carriage is traversed from the first end position to the second end position along the inscription row at a second travel speed, the second travel speed being lower than the first travel speed. The print head is inactive during the traversing to the second end position. The sprayed-on ink is irradiated using the illumination head during the traversing to the second end position. The substrate is then advanced using the transport apparatus.

BRIEF DESCRIPTION OF THE DRAWINGS

The invention will be explained below on the basis of an exemplary embodiment with reference to the drawings, in which.

DETAILED DESCRIPTION

Figure 1:
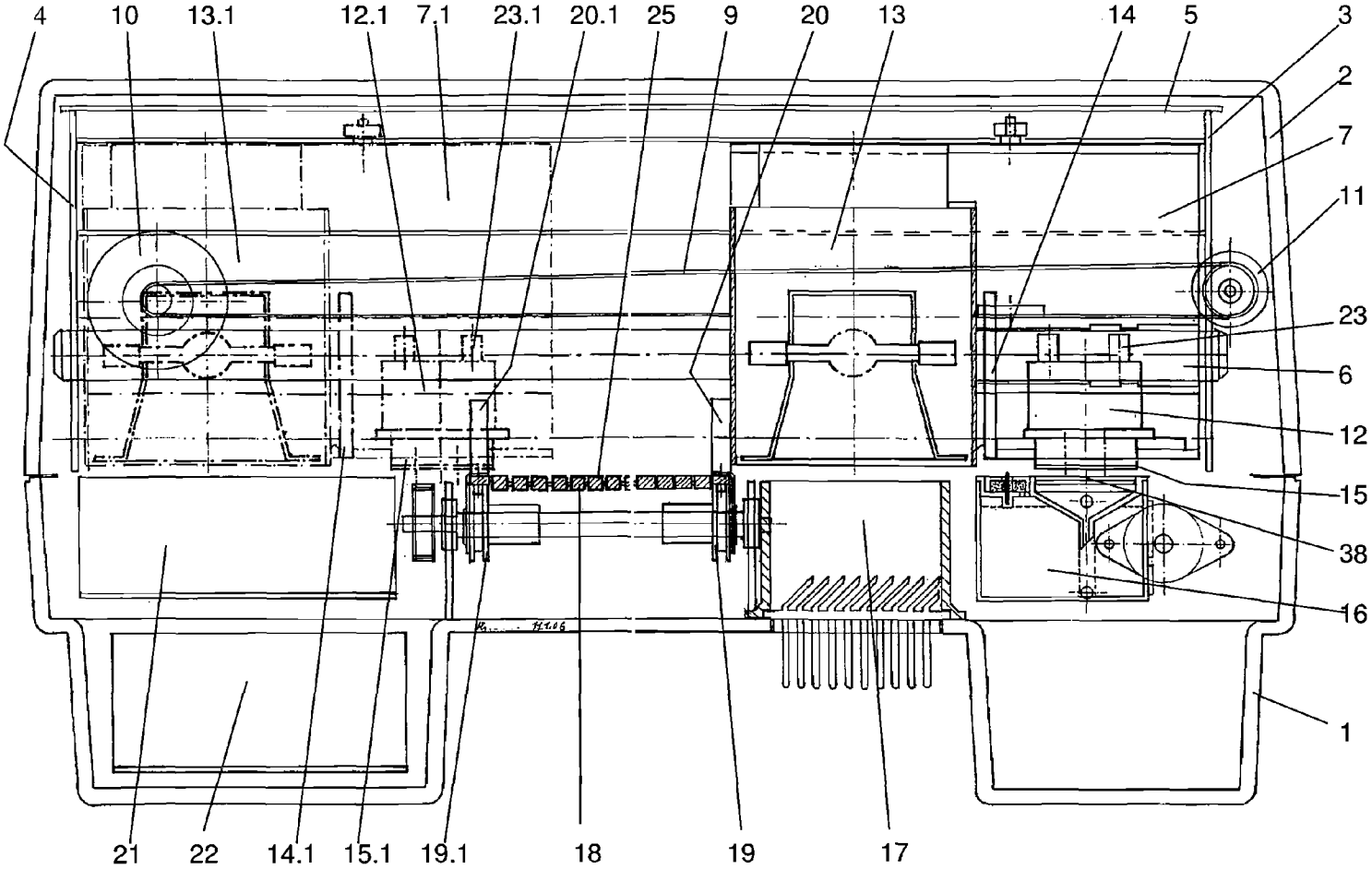
FIG. 1 is a longitudinal section through a printer at right angles to the printing plane, according to the present invention having a print head and an illumination head joined thereto.

With the method according to the present invention for printing with an inkjet printer, the latter's print head and an illumination head, joined thereto, are moved during printing operation in traversing fashion between a first housing side and a second housing side. On the forward travel to the first housing side, light-curing ink is sprayed in controlled fashion onto the substrate while the illumination head irradiates the light-curing ink sprayed onto the substrate. On its return travel to the second housing side the illumination head irradiates the light-curing ink sprayed onto the substrate again, i.e. a second time. After the second irradiation, the substrate is transported transversely to the motion direction of the print head.

As a result of the first irradiation of the ink sprayed onto the substrate as the print head travels forward with the illumination head to the first housing side, the viscosity of the sprayed-on ink is elevated and it becomes gelled. This eliminates spreading of the sprayed-on ink, and ensures a sharp-edged printed image. As a result of the repeat irradiation of the ink sprayed onto the substrate as the illumination head travels back to the second housing side, the ink is cured. The advantage thereby provided is that the printed image of the sprayed-on ink is smear-proof and scratch-proof.

In addition to the aforesaid advantages, the present invention has the advantage that the light-curing ink is cured with low illumination-head radiation power levels. Low radiation power levels are sufficient in the method according to the present invention because the light-curing ink is irradiated the first time as the illumination head travels to the first housing side, and then again as it travels to the second housing side; on the travel segment to the second housing side, the print head stores and retains all the ink. No light-curing ink is therefore sprayed out of the print head on this travel segment. Once the illumination head reaches an end position in the region of the second housing side, the substrate is then transported transversely to the motion direction of the print head.

It has been found that the radiation energy required from an illumination head for printing is determined essentially by two functions. One is to immobilize the ink sprayed onto the surface of the substrate in order to prevent spreading of the ink. On the other hand, the radiation energy serves to cure and completely harden the sprayed-on ink so that it adheres to the substrate.

According to an advantageous embodiment of the present invention, in a printing operation the two functions are essentially performed successively in time by the fact that the illumination head, in the activated state, is moved at different speeds as it travels to the first housing side and as it travels to the second housing side. On the travel segment to the first housing side, the sprayed-on ink is gelled and immobilized on the substrate, while on the travel segment to the second housing half it is cured and completely hardened. As a result of the different speeds of the illumination head, and the correspondingly different irradiation durations, the radiation energy can be apportioned in functionally correct fashion and reduced. Because the radiation energy requirement for immobilizing the ink and for avoiding spreading of the ink is lower than the radiation energy needed to cure the ink, the radiation energy required from the illumination head can be reduced by the fact that the illumination head, in the activated state, can be moved more quickly on the travel segment to the first housing side than on its travel segment to the second housing side. The printer, with its illumination head, can be operated in particularly energy-saving fashion if the illumination head is moved several times more quickly to the first housing side than to the second housing side, since only a low radiation energy is needed to immobilize the ink.

The printer according to the present invention is preferably embodied as a desktop printer, and comprises substantially a housing pan 1 and an upper housing part 2 in which a printer frame having side walls 3, 4 is provided. The latter are spaced apart by an angled crossmember 5. Installed on the printer frame is a carriage guide 6 on which a carriage 7, 7.1 is mounted. Carriage 7, 7.1 is driven via an endless tension means 9 by a motor 10, tension means 9 being deflected by a pulley 11. A print head 12, 12.1, and next to it an illumination head 13, 13.1, are installed on carriage 7, 7.1.

Located between the two is a heat protection shield 14, 14.1 that protects print head 12, 12.1 from thermal radiation of illumination head 13, 13.1.

When carriage 7 is in the neutral position, a cleaning device 16 for print head 12 is provided below a nozzle device 15 of print head 12.

Located below illumination head 13 is a light transformation device 17 in which, when carriage 7 is in the neutral position, the light energy of illumination head 13 is converted into heat and discharged outward.

As a result of the arrangement of the assemblies with respect to one another in the manner described, illumination head 13 does not travel over cleaning station 16 as the carriage moves. This prevents illumination head 13 from hardening ink residues that adhere to cleaning station 16, in particular to its sealing surface 38.

An inscription carrier 18 is depicted in section, at the center of the printer below a nozzle device 15, 15.1 joined to print head 12, 12.1, as a substrate; said carrier is transported by transport device 19, 19.1 transversely to the carriage transport direction and is pressed against transport elements 19, 19.1 by pressure elements 20, 20.1.

A unit controller 21 and a power supply device 22 are located in housing pan 1 to the left of transport device 19, 19.1.

Located in the upper region of print head 12, 12.1 is an ink delivery system 23, 23.1 with which print head 12, 12.1 is supplied with ink, via a hose not depicted here, from a tank mounted on carriage 7, 7.1.

Figure 2:
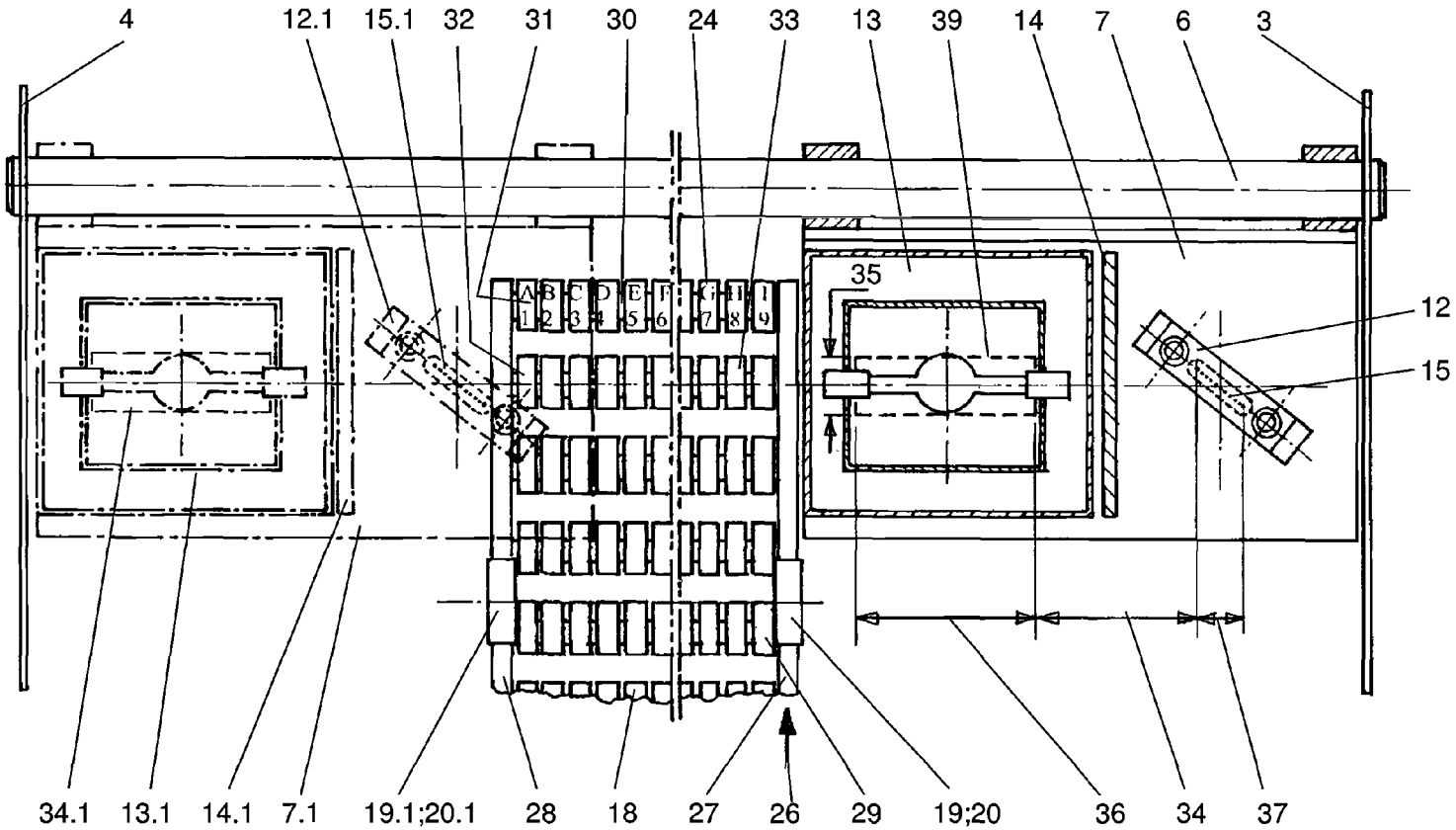
FIG. 2 is a plan view of a portion of the printer of FIG. 1 parallel to the printing plane, with a partly inscribed inscription carrier as substrate.

As shown in FIG. 2, transport device 19, 19.1, 20, 20.1, which moves printed image carrier 18 linewise in the direction of the arrow labeled 26, is arranged between the two end positions of the traversing carriage 7, 7.1.

Inscription carrier 18 is made up of guide struts 27, 28 between which inscription elements 29 are attached at defined break points 30. In FIG. 2, a first row 31 of inscription elements 29 is shown inscribed, while second row 32 is in the inscription position.

Before inscription of this second row 32 of inscription elements, carriage 7, 7.1 is in position 7.1. By means of a command from unit controller 21, carriage 7.1, with print head 12.1 and illumination head 13.1, moves at high printing speed to the right toward side wall 3. In that context, print head 12 sprays ink droplets in program-controlled fashion at selected points onto inscription carrier elements 33 of inscription carrier element row 32. Print head 12 is followed at a short distance 34 by illumination head 13, which comprises a rectangular illumination window 39 having a width 35 and a length 36. Because of the high printing speed and the short distance 34 selected between print head 12 and illumination window 39, the ink sprayed onto a substrate is irradiated, shortly after it strikes the substrate, by illumination head 13 via illumination window 39. The ink sprayed onto the substrate forms lenticular droplets that are irradiated, shortly after they are produced, by the light emitted from illumination head 13. Because of the small time difference between when the ink strikes the substrate surface and when it is irradiated with light, the lenticular ink droplets are polymerized at least in their edge regions. The viscosity in the droplet edge regions thus rises, so that the ink is immobilized. A sharp-edge printed image, which is nevertheless not yet smear-proof in its entirety, is thereby achieved in a first step with a relatively low irradiation power level.

In a second step, illumination head 13 and print head 12 on carriage 7 travel to the left toward side wall 4, in which context illumination head 13 irradiates the sprayed-on ink and print head 12 does not release any ink. Illumination head 13 is moved to the right and to the left at different speeds. Preferably, its speed is greater to the right than to the left. The ratio of the speeds can be as great as a factor of 10, depending on the ink used and the substrate to be imprinted. The speed to the left and/or to the right can also be matched respectively to the ink and to the substrate. Essential parameters for the speeds and the ratio of the speeds are, for example, the material and surface roughness of the substrate, and the ink composition.

Once the carriage has reached end position 7.1, printed image carrier 18 is advanced one row of inscription elements by transport device 19, 19.1, 20, 20.1, and the inscription cycle begins again.

The speed of illumination head 13 and of print head 12 can be controlled as a function of the ink and the substrate, for example, by manually inputting characteristic values therefor into unit controller 21, which then processes the information, compares it with stored data, and classifies it. As a function thereof, unit controller 21 controls the speeds of print head 12 and of illumination head 13.

It is additionally possible for the device controller to control not only the speeds but also the radiation power level of illumination head 13 as a function of the substrate and/or the ink.

LIST OF REFERENCE CHARACTERS

1 Housing pan
2 Upper housing part
3 Side wall
4 Side wall
5 Angled crossmember
6 Carriage guide
7, 7.1 Carriage
9 Tension means
10 Motor
11 Pulley
12, 12.1 Print head
13, 13.1 Illumination head
14, 14.1 Heat protection shield
15, 15.1 Nozzle device
16 Cleaning device
17 Light transformer
18 Inscription carrier
19, 19.1 Transport device
20, 20.1 Pressure elements
21 Unit controller
22 Power supply system
23, 23.1 Ink supply system to print head
24 Inscription element of first row of inscription elements
25 Surface of inscription carrier
26 Arrow in transport direction of inscription carrier
27 Right guide strut of inscription carrier
28 Left guide strut of inscription carrier
29 Inscription element
30 Defined break point
31 First row of inscription elements
32 Second row of inscription elements
33 Inscription element of second row of inscription elements
34 Distance between nozzle device and illumination field
35 Width of illumination field
36 Length of illumination field in printing direction
37 Length of nozzle device of print head in line direction
38 Sealing surface of cleaning station
39 Illumination window

The invention claimed is:

1. A method for inscribing a substrate with an inkjet printer using a light-curing ink, the printer including a carriage configured to traverse between a first end position and a second end position, a print head and an illumination head disposed on the carriage, and a transport apparatus configured to move the substrate linewise, the method comprising:

traversing, by the carriage, to the first end position at a first travel speed;

spraying-on the light-curing ink along an inscription row onto the substrate using the print head during the traversing to the first end position;

irradiating, for curing, the sprayed-on ink using the illumination head during the traversing to the first end position;

traversing, by the carriage, from the first end position to the second end position along the inscription row at a second travel speed, the second travel speed being lower than the first travel speed, the print head being inactive during the traversing to the second end position;

irradiating the sprayed-on ink using the illumination head during the traversing to the second end position; and then advancing the substrate using the transport apparatus.

2. The method as recited in claim 1, wherein the first travel speed is at least two times higher than the second travel speed.

3. The method as recited in claim 1, further comprising:

setting the first travel speed so as to incompletely cure the sprayed-on ink; and setting the second travel speed so as to complete the curing of the sprayed-on ink.

4. The method as recited in claim 2, further comprising:

setting the first travel speed so as to incompletely cure the sprayed-on ink; and setting the second travel speed so as to complete the curing of the spayed-on-ink.

* * * * *